US005813306A

United States Patent [19]

Jacoff

[11] Patent Number: 5,813,306

[45] **Date of Patent: *Sep. 29, 1998**

[54] MITRE BOX OR SIMILAR ARTICLE

[75] Inventor: Daniel Jacoff, Mineola, N.Y.

[73] Assignee: Great Neck Saw Manufacturers, Inc.

[ * ] Notice: The portion of the term of this patent subsequent to Jul. 2, 2010, has been disclaimed.

[21] Appl. No.: 786,258

[22] Filed: Jan. 22, 1997

Related U.S. Application Data

[63] Continuation of Ser. No. 457,593, Jun. 1, 1995, abandoned.

[51] Int. Cl.[6] ..... B27G 5/02

[52] U.S. Cl. ..... 83/762; 83/468; 83/522.11; 83/581

[58] Field of Search ..... 83/762, 581, 477.2, 83/522.11, 468

[56] References Cited

U.S. PATENT DOCUMENTS

| | | | |
|---|---|---|---|
| D. 371,301 | 7/1996 | Jacoff | D8/71 |
| 762,161 | 6/1904 | Frank | 83/581 X |
| 1,013,010 | 12/1911 | Graham | 83/468 X |
| 3,837,253 | 9/1974 | Slemmons | 83/762 |
| 3,935,779 | 2/1976 | Hildebrandt et al. | 83/762 |
| 4,281,827 | 8/1981 | Horwath | 83/581 X |
| 4,461,196 | 7/1984 | Schramm, II | 83/581 X |
| 4,712,462 | 12/1987 | Cvek | 83/468 X |
| 5,063,983 | 11/1991 | Barry | 83/574 X |

FOREIGN PATENT DOCUMENTS

| | | | |
|---|---|---|---|
| 8900297 | 9/1989 | Netherlands | 83/581 |
| 2195950 | 4/1988 | United Kingdom | 144/286.1 |

*Primary Examiner*—Eugenia Jones
*Assistant Examiner*—Charles Goodman

[57] ABSTRACT

A mitre box having a base and a pair of upstanding spaced sidewalls extending upwardly from the base. Each sidewall has an end edge, a slot in each of the sidewalls, the slots being in angular axial alignment with each other with the slot in one of the sidewalls being in axial angular alignment with the slot in the opposite sidewall, ruler marks on said mitre box substantially parallel to the sidewalls. Notch means are also provided between the two end edges of the sidewalls.

4 Claims, 1 Drawing Sheet

MITRE BOX OR SIMILAR ARTICLE

This application is a continuation of U.S. application Ser. No. 08/457,593 filed Jun. 1, 1995, now abandoned.

BACKGROUND

The present invention relates to mitre boxes and more particularly to a mitre box adapted to be used for cutting pieces of wood and the like at an angle.

Mitre boxes have been used for a number of years and are made of wood or some other suitable material. Mitre boxes usually have a base and a pair of upstanding side walls. The sidewalls (and often the base) have slots formed therein at various angles. The angle of a slot in one sidewall being in alignment with the angle of a slot on the opposite sidewall. If there is a slot in the base it will join the two side wall slots. In this manner, a saw blade may be inserted in the slots and be in the position to cut down on a piece of wood or similar material at the exact angle of the slots.

Existing mitre boxes do not have ruler marks so that the user is unable to determine the length of wood to cut and instead must resort to a separate ruler or tape measure. In addition, if the mitre box is made out of a plastic material it has been found that the mitre box cannot easily be molded in a single piece.

OBJECTS

The present invention avoids these problems and has for one of its objects the provision of an improved mitre box which has rule marks thereon.

Another object of the present invention is the provision of an improved mitre box in which ruler marks are provided both at the base and along the sidewalls.

Another object of the present invention is the provision of an improved mitre box in which the configuration of the mitre box is such that it may be easily molded from a suitable plastic.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
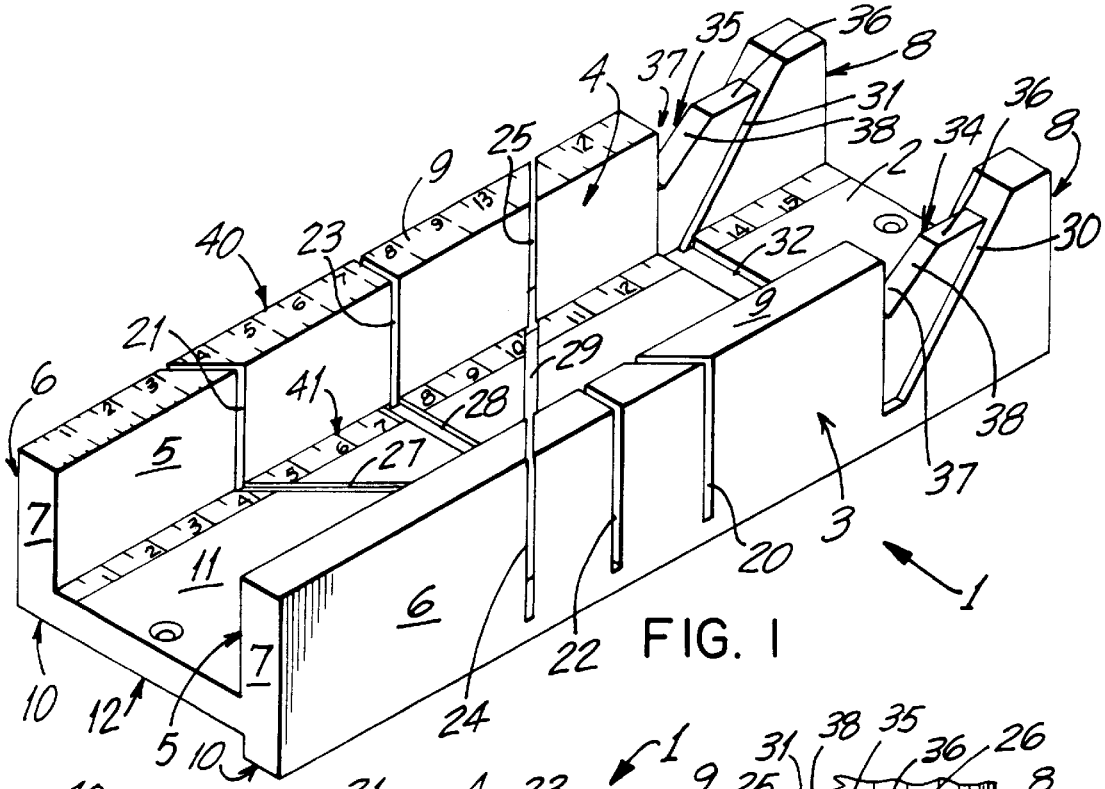
FIG. 1 is a perspective view of a mitre box made in accordance with the present invention.
Figure 2:
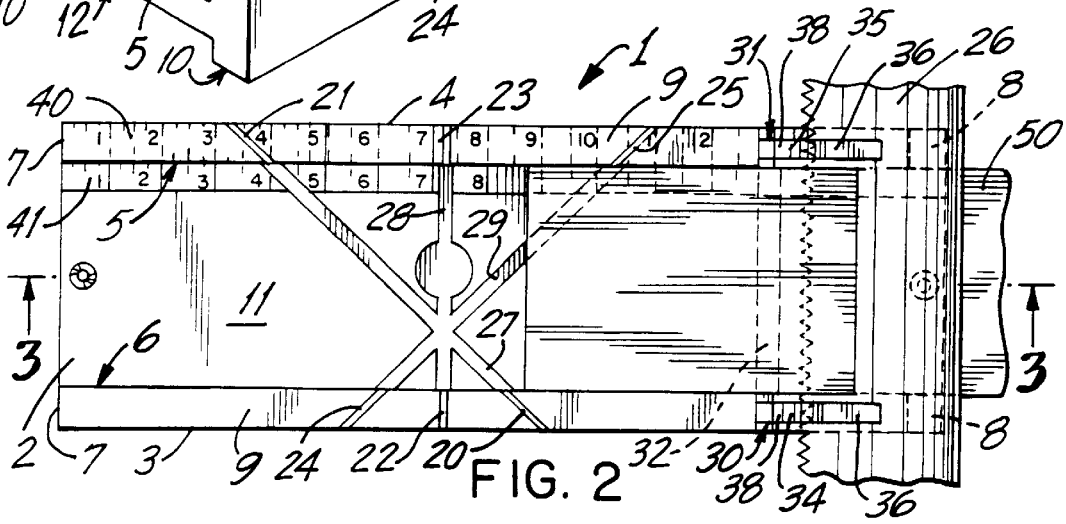
FIG. 2 is a top plan view thereof.
Figure 3:
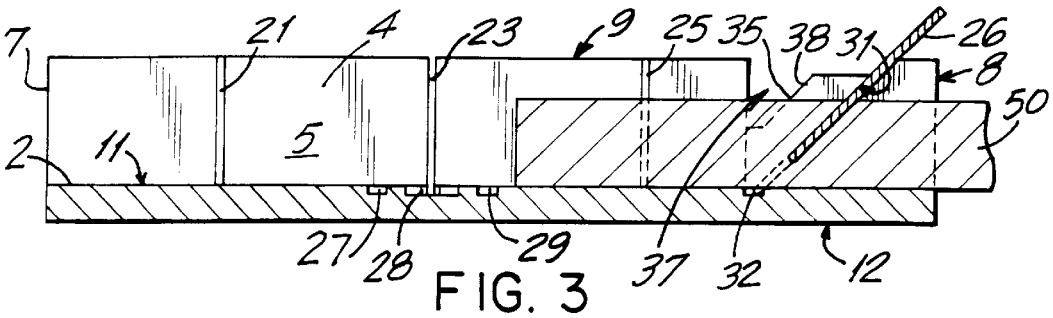
FIG. 3 is a sectional view taken along line 3—3 of FIG. 2.

Referring to the drawings, the mitre box 1 of the present invention is preferably made in one piece from a plastic or similar material. The mitre box 1 comprises a flat base 2 and a pair of upstanding sidewalls 3 and 4 extending upwardly from the base 2. Each side wall 3 and 4 comprises inner and outer faces 5 and 6, front and rear edges 7 and 8, and top and bottom edges 9 and 10. The base 2 has a top face 11 and a bottom face 12 which is shown as being on the same plane as lower edge 10 of sidewall 4 and above lower edge 10 of sidewall 3.

The base 2 is adapted to have a piece of wood 50 or similar material moved along its upper face 11 between the sidewalls 3 and 4. The sidewalls 3 and 4 have a plurality of slots 20–21, 22–23 and 24–25 which are angled relative to each other and which extend from the base 11 to the top edge 9 of each sidewall 3 and 4. The slots 20, 22 and 24 in one sidewall 3 are in alignment with a corresponding slots 21, 23 and 25 in the other side wall 4. In this manner a saw blade 26 may be inserted into the aligned slots 20–21, 22–23, 24–25 and make a straight angled cut in a piece of wood. In the drawing the slots 22–23 are shown as being perpendicular to the sidewalls 3–4 and slots 20–21 and 24–25 at approximately 45 degree angles to the sidewalls 3–4 and substantially at right angles to each other. However, it will be understood that these angles may change without departing from the invention. In addition, the base 2 has grooves 27, 28 and 29 in its upper face 11 which are in alignment with the various sidewall slots 20–21, 22–23 and 24–25, respectively. With this construction, when a piece of wood is placed over one of these grooves 27, 28, 29 and a saw blade 26 is moved down to cut the wood, it will be assured that the wood is cut straight through since the teeth of the saw 25 will move into the grooves 27, 28 and 29.

In addition, there are saw blade slots 30–31 adjacent to the end edges 8, which are at an angle to the vertical and at right angles to the side walls 3 and 4. These slots 30–31 are adapted to permit a piece of wood to be cut at an angle to the vertical. A groove 32 in base 2 is coextensive with and connects the two slots 30–31 together.

For ease in molding the mitre box 1 of the present invention in one piece, notch elements 34–35 are formed in the sidewalls 3 and 4 adjacent end edges 8. The notch elements are narrower than the thickness of the side walls 3 and 4 and its top edges 36 are below the top edges 9 of the sidewalls 3 and 4. These notch elements 34–35 are formed from the sidewalls and have notches 37—37 with angled top walls 38—38 to give these elements resiliency.

Along the top edge 9 of the sidewalls 3 and 4 and, preferably, also along the flat upper face 11 of the base 2 there are numbered ruler marks 40 and 41, respectively, which in the drawings have been indicated as being twelve inches and sixteen inches respectively. These ruler marks 40–41 will permit the user to place a piece of wood at a particular length before cutting. If the wood is wide enough to cover the ruler marks 41 on the base face 12, the user may use the ruler marks 40 on the top of the sidewall 4 as a guide. Hence, regardless of the thickness of a piece of wood, the user can always know the length at which to cut it by using these markers.

It will thus be seen that the present invention provides an improved mitre box which has ruler marks thereon, which rule marks are provided both at the base and along the sidewalls and in which the configuration of the mitre box is such that it may be easily molded in one piece from a suitable plastic.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mitre box comprising a base and a pair of upstanding spaced parallel sidewalls extending upwardly from said base with each sidewall having substantially parallel front and rear end edges and a top edge substantially perpendicular to said front and rear end edges, each sidewall having a predetermined thickness, at least one slot in each of the sidewalls, the slot in one of said sidewalls being in alignment with the slot in the other sidewall, said base having an upper surface which is substantially on one plane, a groove extending across the entire upper surface of said base connecting and communicating with the slot in said sidewalls, ruler marks on said mitre box substantially parallel to said sidewalls and perpendicular to said end edges, notch means between the pair of end edges of each of said sidewalls, each of said notch means comprises a notch element having a thickness less than the thickness of the sidewall in which the notch element is located, each notch element having a top edge below the top edge of the sidewall in which each notch edge is located, each notch element having an inclined wall extending from the top edge of the notch element toward said base, the inclined wall of the notch element being connected to and terminating at the sidewall in which the notch element is located, a notch element slot in each side wall between the notch element in the side wall in which the notch element is located and the rear end edge of each of said side walls, said notch element slot extending upwardly from the base and being at an angle to said rear end edge, and a groove extending across the entire upper surface of said base connecting and communicating with the notch element slot in each side wall.

2. A mitre box as set forth in claim 1, wherein said ruler marks are on the top edge of one of said sidewalls.

3. A mitre box as set forth in claim 1 wherein said ruler marks are on said base.

4. A mitre box as set forth in claim 1 wherein said ruler marks are on said base and on the top edge of one of said sidewalls.

* * * * *